US005239791A

United States Patent [19]

Mills, Jr. et al.

[11] Patent Number: 5,239,791

[45] Date of Patent: Aug. 31, 1993

[54] ADJUSTABLE COPING ASSEMBLY

[75] Inventors: R. Frank Mills, Jr., Sanford, N.C.; James N. McClatchey, Atlanta, Ga.

[73] Assignee: Southern Aluminum Finishing Company, Atlanta, Ga.

[21] Appl. No.: 869,331

[22] Filed: Apr. 15, 1992

[51] Int. Cl.[5] ..... E04D 3/38

[52] U.S. Cl. ..... 52/58; 52/60; 52/96; 52/300

[58] Field of Search ..... 52/58-62, 52/94-96, 300, 211, 212, 213, 573

[56] References Cited

U.S. PATENT DOCUMENTS

| | | | |
|---|---|---|---|
| Re. 27, 761 | 9/1973 | Attaway . | |
| 1,740,753 | 12/1929 | Vallas . | |
| 2,554,779 | 5/1951 | Goodwin . | |
| 2,734,602 | 2/1956 | Dawson . | |
| 2,855,776 | 10/1958 | Trostle . | |
| 2,920,477 | 1/1960 | Shaw . | |
| 3,012,376 | 12/1961 | Reddy et al. . | |
| 3,090,161 | 5/1963 | Edwards . | |
| 3,237,352 | 3/1966 | Edwards . | |
| 3,405,485 | 10/1968 | Edwards . | |
| 3,447,273 | 6/1969 | Thom . | |
| 3,469,357 | 9/1969 | Seidler | 52/300 |
| 3,545,135 | 12/1970 | Lieber | 52/213 X |
| 3,696,575 | 10/1972 | Armstrong . | |
| 3,719,010 | 3/1973 | Hickman . | |
| 3,738,068 | 6/1973 | Attaway . | |
| 3,802,140 | 4/1974 | Hickman . | |
| 3,862,531 | 1/1975 | Attaway et al. . | |
| 4,071,987 | 2/1978 | Hickman . | |
| 4,083,158 | 4/1978 | Wolma . | |
| 4,472,913 | 9/1984 | Hickman . | |
| 4,483,112 | 11/1984 | Rueblinger . | |
| 4,488,384 | 12/1984 | Hickman . | |
| 4,549,376 | 10/1985 | Hickman . | |
| 4,617,770 | 10/1986 | Hickman . | |
| 4,798,033 | 1/1989 | Weidl . | |
| 4,800,689 | 1/1989 | Lane . | |
| 4,858,406 | 8/1989 | Lane et al. . | |
| 4,890,426 | 1/1990 | Hickman et al. . | |
| 4,964,248 | 10/1990 | Braine et al. . | |

FOREIGN PATENT DOCUMENTS

| | | |
|---|---|---|
| 2118981 | 10/1972 | Fed. Rep. of Germany . |
| 1104027 | 2/1968 | United Kingdom . |
| 1180965 | 2/1970 | United Kingdom . |
| 1347974 | 2/1974 | United Kingdom . |

OTHER PUBLICATIONS

Materials Sheet—"Pressloc Coping" (Southern Aluminum Finishing Co., North Carolina), 1 page.

"Extruded Aluminum Gravel Stops and Copings—Extruded Aluminum Copying Type, G-8, G-12, G-6,and G-11" 2 pages.

"Snap-lok Coping," (MM Systems, Inc.), 1 page.

Drawing—Full Coping (Metal-Era, Inc., Wisconsin), 1 page.

Trion-Architectural Copings (Special Metals Division) 1 page.

C/S Colortrip Coping (Construction Specialties), 2 pages.

Overly Metal Coping (Overly Manufacturing Co., Los Angeles), 4 pages.

*Primary Examiner*—Carl D. Friedman
*Assistant Examiner*—Kien Nguyen
*Attorney, Agent, or Firm*—Kilpatrick & Cody

[57] ABSTRACT

A fully-adjustable coping assembly capable of conforming to a wide variety of parapets, walls, and other structures is disclosed. Embodiments of the assembly comprise two toothed, interconnected elements which not only telescope as necessary but, when connected, form an internal gutter as well. The elements may be made of PVC or other non-metal if desired to facilitate on-site cutting and fitting. Complementary cover and splice plates also are disclosed for coupling discrete sections of the coping assembly. The cover and splice plates themselves can be interconnected to seal the entire assembly and provide another internal gutter for redirecting fluid away from the protected surface.

20 Claims, 4 Drawing Sheets

ADJUSTABLE COPING ASSEMBLY

This invention relates to building and roofing materials and more particularly to coverings for parapets or similar structures.

BACKGROUND OF THE INVENTION

Buildings, particularly those having flat roofs, may include parapets or comparable structures extending above their roof lines on one or more sides. These parapets typically perform dual functions, themselves enhancing the aesthetic appearance of the building while preventing rainwater and other fluid contaminants from flowing from the roof onto the adjacent building faces. Blocking the flow of fluids also helps preserve the building appearance by reducing discoloration of the building faces, for example, and assists in maintaining the structural integrity of the facial components as well.

Because the parapets are exposed to the atmosphere, they too may require protection from moisture and other pollutants. Copings thus have been developed to cover, or cap, the relatively horizontal upper surfaces of parapets. These copings, currently (at least) virtually exclusively made of metal, are designed to extend the width of the upper surface of the parapets and redirect fluid away from the upper surface. Among the simplest coping is a single solid aluminum or other metallic sheet measured (on-site) and cut (typically off-site) to fit a particular upper parapet surface and nailed to the upper surface or a galvanized steel base. If the width of the parapet surface is not uniform, however, the tasks of cutting and fitting the metallic sheet to create a fluid-tight seal are often both difficult and time consuming. Unless the metallic sheet is inclined, moreover, it may not effectively redirect fluid with which it comes in contact.

U.S. Pat. No. 4,964,248 to Braine, et al. recognizes that parapet wall widths are frequently non-uniform throughout their lengths. Consequently, the Braine patent discloses a multi-piece coping assembly in which a top plate and a fascia member may be telescoped. Such telescoping permits adjustment of the width of the coping assembly, thereby better accommodating varying parapet thicknesses as a function of their length. According to the Braine patent, a resilient clamping means holds the top plate in place, including opposing surfaces of the fascia member and a clip member which engage in multiple locations to interconnect the components. The patent does not disclose satisfactory guttering action should fluid seep beneath the top plate, however, nor does it discuss covering joints where, for example, parapet walls meet at an angle.

U.S. Pat. No. 4,083,158 to Wolma, by contrast, discloses an adjustable mounting plate onto which a single-sheet coping may be mounted. The two-piece mounting plate is nailed to the parapet surface so as to span the parapet width at selected points. Subsequently, the single-sheet coping may be shaped as necessary to fit the series of mounting plates and ultimately snapped into place. Like the Braine patent, the Wolma patent (both of which are incorporated herein in their entireties by this reference) fails to address guttering problems caused by fluid seepage beneath the coping's upper surface and leakage which sometimes may be present at either straight or curved joints.

SUMMARY OF THE INVENTION

The present invention provides a fully-adjustable coping assembly capable of accommodating a wide variety of parapet widths. In one embodiment of the invention, the assembly comprises two interlocking pieces which not only telescope as necessary but, when connected, form an internal gutter as well. The interlocking pieces may be made of PVC or other non-metal if desired to facilitate cutting (with conventional roofing tools) and fitting on-site. Using discrete, toothed structures as an interlock mechanism also provides ample space for thermal expansion and contraction of the pieces to occur when installed on a particular parapet. For purposes of this patent application, the term "parapet" encompasses walls and any other structures that may be capped or otherwise covered for aesthetic, protective, or other reasons.

More specifically, embodiments of the present invention include male and female elements which, when interconnected, form an adjustable coping assembly The male element of these embodiments comprises a first, hooked leg designed to attach to a pre-installed cleat and a second, toothed leg integrally formed with the hooked leg at an angle slightly less than ninety degrees. The female element similarly includes a hooked leg for attaching to a pre-installed cleat opposite that for the male element. An integrally formed, multi-segment leg extends from the hooked leg of the female element at an initial angle of slightly less than ninety degrees. The multiple segments form a pocket to receive the toothed leg of the male element. The pocket similarly includes teeth which mesh with the toothed leg to interconnect the two elements and forms an internal gutter for redirecting away from the protected parapet surface any fluid which might penetrate the coping assembly.

The present invention also provides cover and splice plates for coupling discrete sections of the coping assembly. The cover and splice plates themselves can be interconnected to seal the entire assembly and provide another internal gutter for redirecting fluid away from the protected surface. In one embodiment of the invention the splice plate, which when positioned initially abuts the parapet surface, comprises flanged longitudinal edges (for forming the internal gutter) and a central elongated slot. The cover plate includes a complementary rail designed to be inserted in the slot. When inserted, the rail also functions to pull the splice plate a short distance from the parapet surface and thereby improve the resulting seal.

Although the various components of the coping assembly may be made of metal, the present invention also contemplates use of alternative, non-metallic materials such as PVC and other plastics. These more pliable materials are easily fitted and cut on-site with conventional roofing tools, virtually eliminating the need for off-site fabrication of components. On the other hand, PVC and analogous materials are susceptible to greater thermal expansion and contraction than typically-used metals, precluding their use as coping in connection with pre-existing designs. As noted above, however, the spaced teeth of the present invention accommodate this greater expansion and contraction of the male and female elements, providing areas for the expansion and contraction to occur. The couplings formed by the cover and splice plate with adjacent sections of the coping assembly similarly permit thermal expansion and contraction without degrading the integrity of the seal.

It is therefore an object of the present invention to provide a coping assembly capable of accommodating a variety of parapet widths.

It is also an object of the present invention to provide a coping assembly with telescoping, interconnecting elements.

It is an additional object of the present invention to provide a coping assembly with toothed male and female elements which interconnect to form an internal gutter.

It is yet another object of the present invention to provide separate but interconnectable covers and splice plates for coupling to the coping assembly at joints.

It is further an object of the present invention to provide splice plates which include an internal gutter for redirecting any fluid penetrating the coping assembly.

It is also an object of the present invention to provide a coping assembly and related materials made of nonmetallic materials.

Other objects, features, and advantages of the present invention will become apparent with reference to the remainder of the text and the drawings of this application.

DETAILED DESCRIPTION

Figure 1:
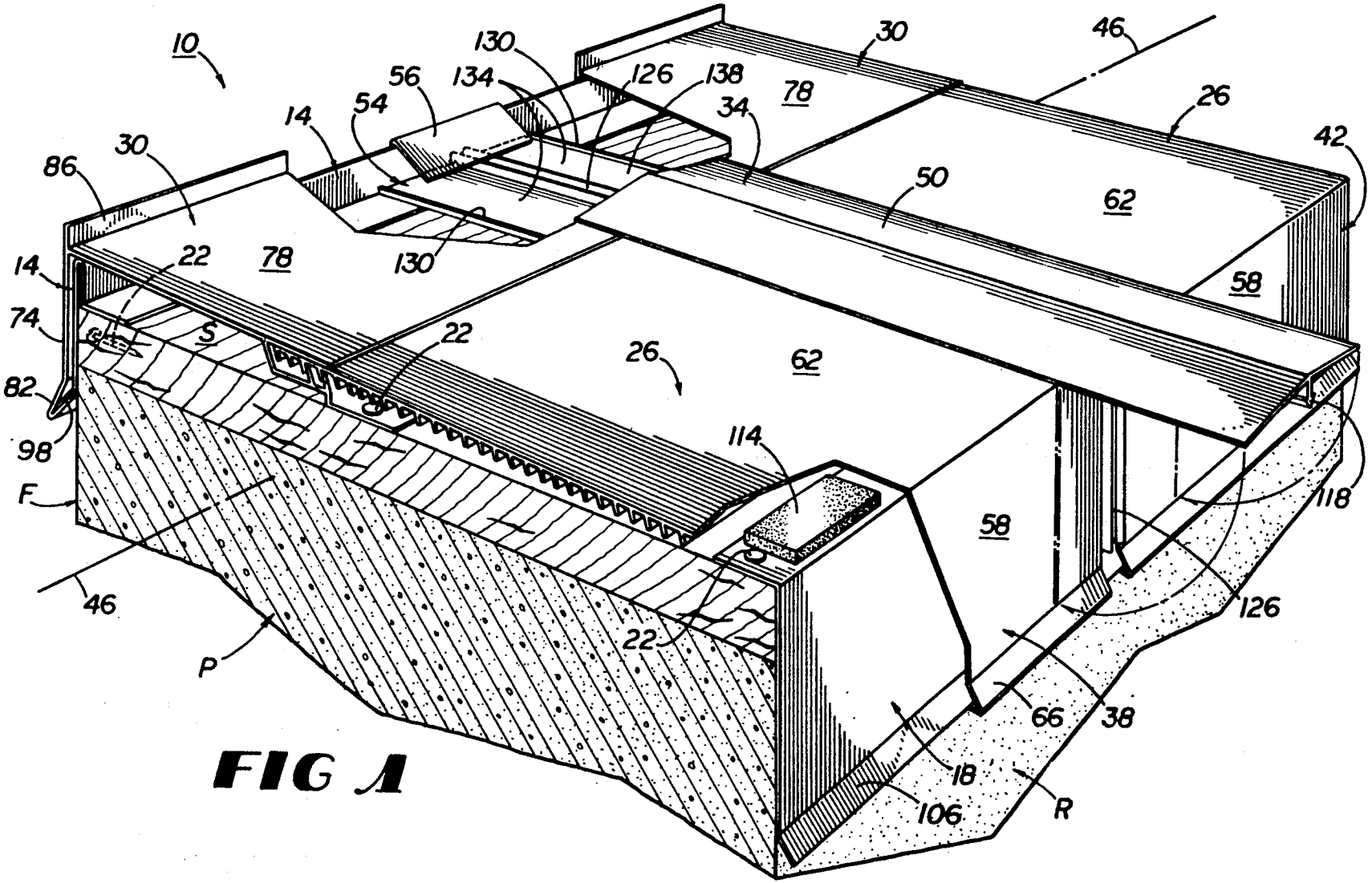
FIG. 1 is a perspective view of a section of the coping assembly and related components, including a joint cover, of the present invention shown partially cut away to reveal a portion of a splice plate corresponding to the cover.

FIG. 1 illustrates generally a coping assembly 10 of the present invention attached to a parapet P. As shown in FIG. 1, assembly 10 includes (nominally) front and rear cleats 14 and 18, respectively, and nails 22 or other means for fastening cleats 14 and 18 to the parapet P. Assembly 10 also comprises male and female elements 26 and 30 (see FIGS. 1–4), respectively, which interconnect as appropriate to accommodate a particular width of parapet P. Female element 30 may be fastened to parapet P using fastener such as nail 22, and both male and female elements 26 and 30 may be snapped into position or otherwise coupled to, respectively, front and rear cleats 14 and 18.

Also detailed in FIG. 1 is coupling 34 used to join segments 38 and 42 of assembly 10. FIG. 1 illustrates two such segments of assembly 10 attached along the same longitudinal axis 46 of parapet P to define a straight joint. Segments 38 and 42 may be positioned along different longitudinal axes, however, as when walls of parapet P meet at an angle and define a curved joint. Coupling 34 comprises cover 50 and a corresponding splice plate 54, which themselves interlock to form a single unit when in use. For straight joints, coupling 34 may also be modified to include an angled bridge 56 positioned between a portion of cover 50 and splice plate 54 and attached to front cleat 14.

Figure 2:
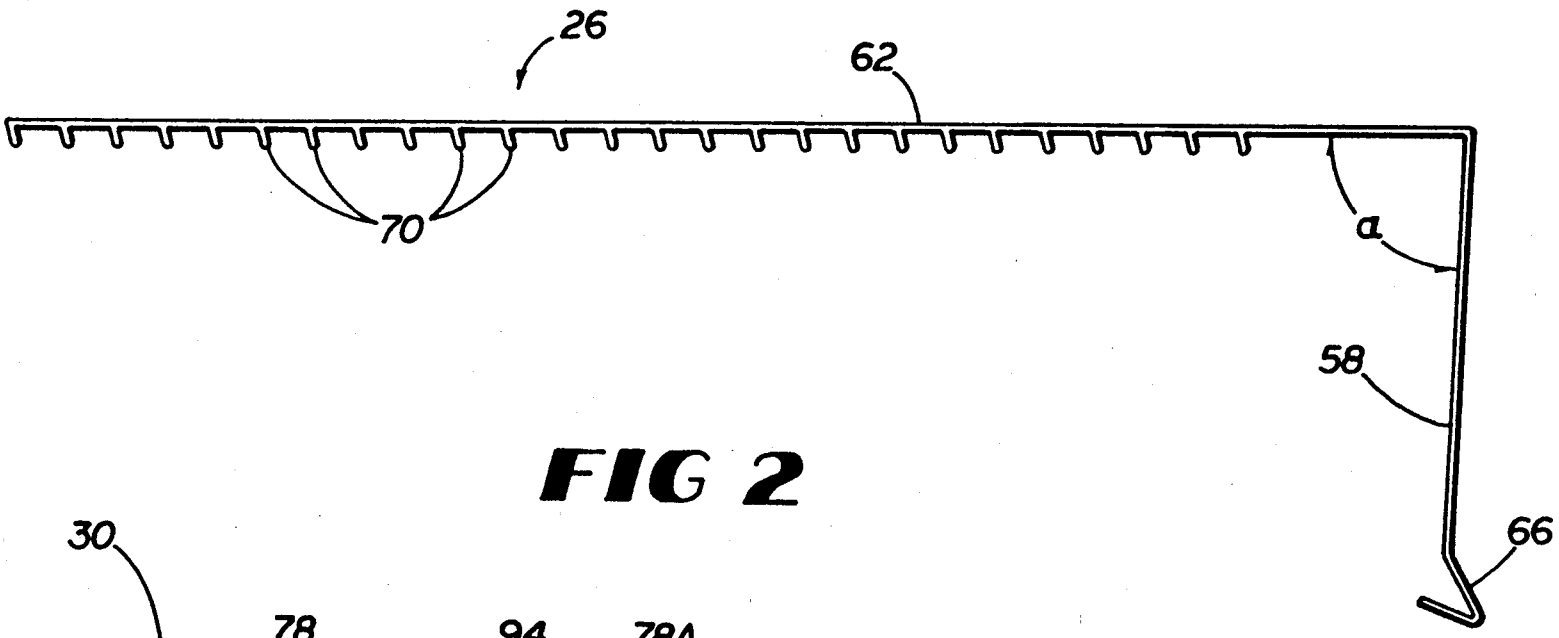
FIG. 2 is a side elevational view of the male element of the coping assembly of FIG. 1.

FIG. 2 further illustrates male element 26 of the coping assembly 10 of the present invention. Male element 26 is defined by first and second legs 58 and 62, with the legs being integrally formed at an angle $\alpha$ typically slightly less than ninety degrees. In the embodiment of FIG. 2, for example, angle $\alpha$ is approximately 83°. The value of angle $\alpha$ is not critical to the invention, however, and legs 58 and 62 may be formed at any suitable or desired angle. First leg 58 terminates in hooked segment 66 for attaching to rear cleat 18. Second leg 62 includes a series of angled, spaced protrusions, or teeth 70, integrally formed therewith. Assuming that coping assembly 10 is attached to the upper horizontal surface S of parapet P (see FIG. 4), teeth 70 will extend downward from second leg 62 toward rear cleat 18.

Figure 3:
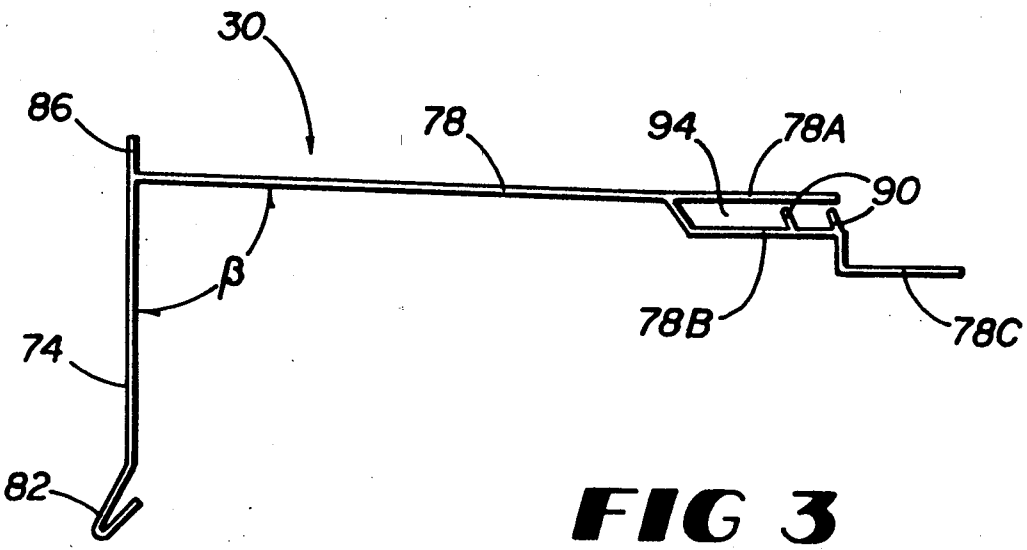
FIG. 3 is a side elevational view of the female element of the coping assembly of FIG. 1.

Female element 30 is shown in FIG. 3. Like male element 26, the female element 30 also is defined by respective first and second legs 74 and 78. First leg 74 terminates in hooked segment 82 for attaching to front cleat 14. Second leg 78, which projects from first leg 74 at a point intermediate its ends, includes multiple segments 78A–C, two of which (segments 78A–B) function to receive male element 26. Because second leg 78 intersects first leg 74 at an intermediate point, it defines an upper segment or flange 86 at the front F of parapet P which helps prevent fluid from draining onto the front F. Forming first and second legs 74 and 78 at an angle $\beta$ typically slightly less than ninety degrees (e.g., 83° as shown in FIG. 3) similarly serves to redirect fluid away from the front F of parapet P. Although not shown in FIG. 3, a face plate or other aesthetic addition conforming to first leg 74 may be clipped to and thereby at least partially held in place by flange 86.

Segment 78C of female element 30, designed to be attached to surface S using nail 22 or other fastener, helps anchor coping assembly 10 to parapet P. Assuming again that coping assembly 10 is attached to the upper horizontal surface S of parapet P (see FIG. 4), segment 78C will depend from segment 78B, which in turn will depend from segment 78A. Like second leg 62 of male element 26, segment 78B includes a series of angled, spaced teeth 90. Teeth 90 extend nominally upward from segment 78B toward forward cleat 14, however, thus complementing teeth 70 of male element 26. Together, segments 78A and 78B define a pocket 94, which receives a selected portion of second leg 62 and thereby permits coping assembly 10 to telescope as necessary or desired.

Figure 4:
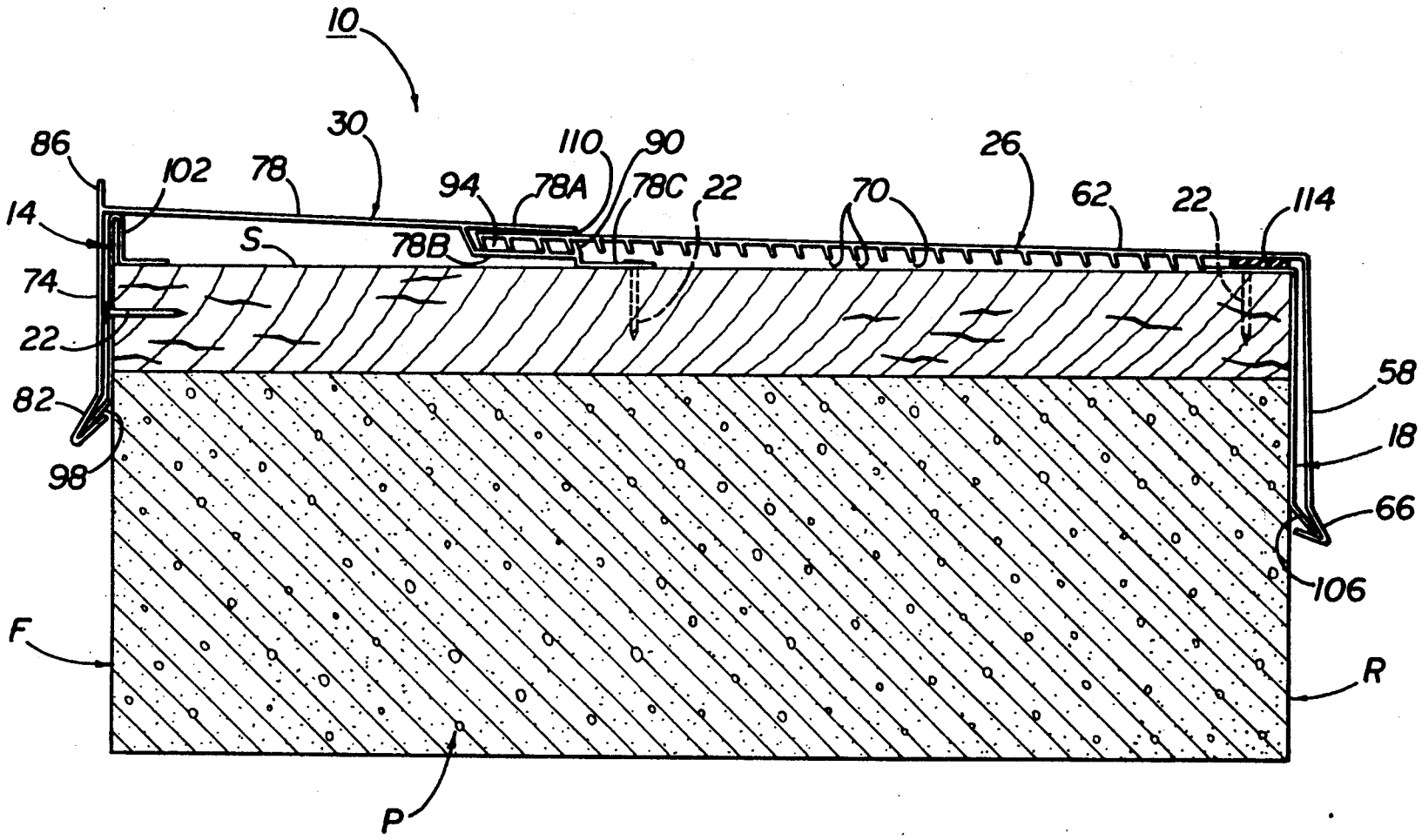
FIG. 4 is a side elevational view of portions of the coping assembly illustrated in FIG. 1.

FIG. 4 shows the interconnection of male element 26 and female element 30 of coping assembly 10. Segment 78C of female element 30 is anchored to parapet P, while hooked segment 82 is snapped over a corresponding curved section 98 of front cleat 14. Because front cleat 14 may also include a looped section 102 extending above the surface S of parapet P, flange 86 and second leg 78 of male element 30 will likewise be sited above the surface S, facilitating drainage of fluid by female element 30 and providing ample space for depending segments 78A–C.

With female element 30 anchored in position, second leg 62 of male element 26 may be inserted into pocket 94 a sufficient distance to permit hooked segment 66 to snap securely over the corresponding curved section 106 of cleat 18. Inserting second leg 62 into pocket 94 permits any selected one or more pairs of teeth 70 and 90 to mesh, effectively locking coping assembly 10 in place and allowing pocket 94 to function as an internal gutter remote from surface S should any fluid penetrate the exterior of the coping assembly 10 (as at seam 110). By using resilient material for segment 78A, the segment 78A may be biased against second leg 62 at seam 110 to minimize the possibility of fluid or other contaminants penetrating the coping assembly 10. Compression strips 114 (FIGS. 1 and 4), which may be made of neoprene or other suitable material, similarly assist in positioning second leg 62 for biasing against segment 78A at seam 110.

Figure 5:
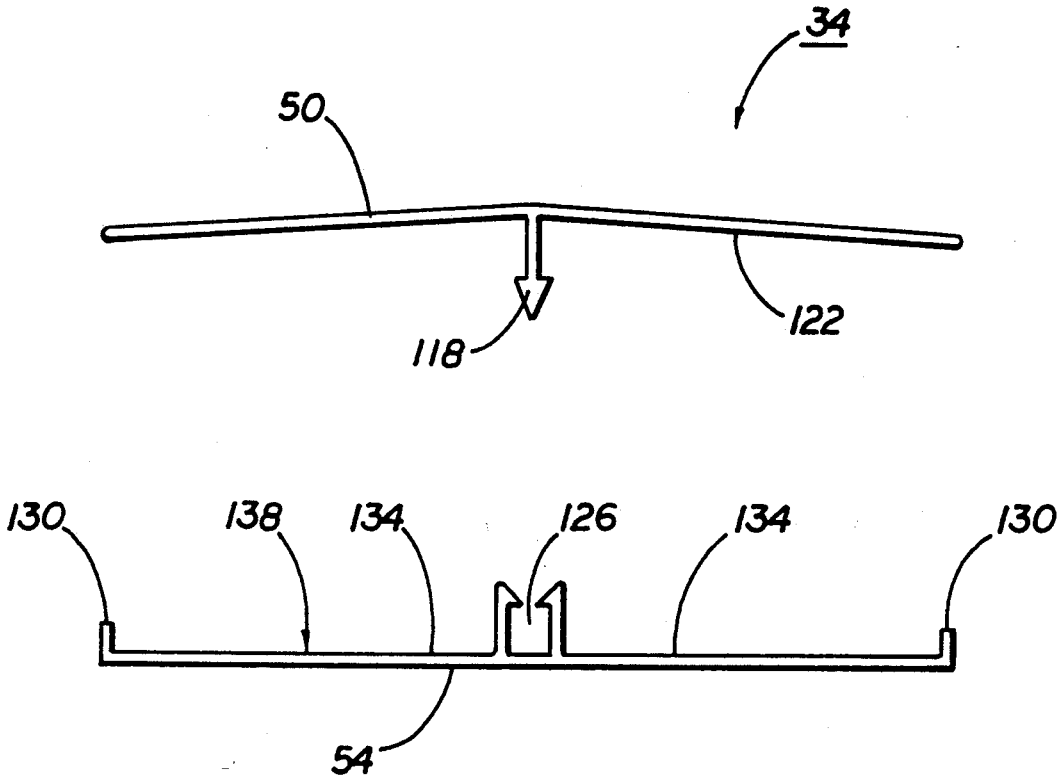
FIG. 5 is an end view of the cover and splice of FIG. 1.

The cooperative relationship between cover 50 and splice plate 54 forming coupling 34 is shown in FIG. 5. Cover 50 includes rail 118 protruding from its nominal underside 122, with rail 118 extending all or part of the length of cover 50. Splice plate 54 comprises slot 126 designed to receive rail 118 and thereby interconnect the cover 50 and splice plate 54. Like rail 118, slot 126 may extend all or part of the length of splice plate 54 as appropriate or desired. Splice plate 54 additionally includes nominally upward extending, longitudinal flanges 130 which trap any penetrating fluid on surface 134 of splice plate 54 and allow it to function as another internal gutter 138 for the overall system. As illustrated in FIG. 1, the slope of coping assembly 10 and coupling 34 direct an fluid contacting surface 134 away from the parapet front F toward rear cleat 18. As installed, coping assembly 10 is sandwiched between cover 50 and splice plate 54 (which themselves are interconnected as noted above), effectively sealing the entire system. Pockets 94, moreover, communicate with internal gutter 138 to redirect any other penetrating fluid toward rear cleat 18.

Coping assembly 10, cover 50 and splice plate 54 may be installed quickly and easily for a length of parapet P. According to one typical installation method, workers initially install a series of front cleats 14 the length of parapet P and spaced sufficiently (e.g., one-eighth inch) to accommodate some thermal expansion. FIGS. 1 and 4 illustrate a front cleat 14 installed on the front F and surface S of parapet P using fasteners such as nails 22. Alternatively, surface S may be the upper surface of a wooden or other substrate spanning the parapet surface.

After installing front cleats 14, workers can install female elements 30 by hooking each hooked segment 82 over a corresponding curved section 98 and fastening each segment 78C to surface S. During this procedure rear cleats 18 can also be installed on the rear R and surface S of parapet P as, for example, illustrated in FIGS. 1 and 4, and splice plates 54 positioned as appropriate throughout the length of parapet P.

Male elements 26 may then be installed. Preliminarily, excess lengths of the second legs 62 of male elements 26 may be cut on-site, with conventional roofing tools, as necessary to fit within pockets 94. Using a scissors motion, a worker need merely slide each second leg 62 into a corresponding pocket 94 a sufficient distance to allow hooked segment 66 to snap over curved section 106 of cleat 18. Doing so meshes spaced teeth 70 and 90, interconnecting each male and female element 26 and 30 and thereby forming each coping assembly 10.

Workers can subsequently install covers 50 over coping assemblies 10 and splice plates 54 by sliding or snapping rails 118 into corresponding slots 126. Installing covers 50 essentially completes the roofing system, with pockets 94 communicating with gutters 138 as described above. Thus, fluid or other contaminants contacting the exterior of coping assembly will be directed away from parapet surfaces F and S and toward surface R, and any fluids penetrating assembly 10 will similarly be directed through pockets 94 and gutters 138 toward rear cleat 18 and surface R. Cover 50 may be bent over rear cleat 18 if desired (see FIG. 1) to couple to any portion of splice plate 54 positioned adjacent parapet rear R, and caulk may be applied to any portions of assembly 10 and coupling 34 if additional protection is desired.

By using PVC or other plastics for the various components of the present invention, they can be cut, fit, slid, snapped, and secured in position on-site with minimal effort and tooling. Utilizing non-metals for components of the present invention also avoids the oxidation, rusting, and corrosion associated with certain of the metals currently in use. Although these plastics are susceptible to greater thermal expansion and contraction than metals used with existing copings, the spaces between teeth 70 and 90 (even when meshed) easily accommodate such expansion and contraction by permitting lateral relative movement of male and female elements 26 and 30.

The foregoing is provided for purposes of illustration, explanation, and description of embodiments of the present invention. Modifications and adaptations to these embodiments will be apparent to those of ordinary skill in the art and they may be made without departing from the scope and spirit of the invention. Without limiting the foregoing, the present invention recognizes that differing means for interconnecting male and female elements 26 and 30, including various shaped teeth, compression bars, and other non-toothed structures, may be employed. Similarly, a variety of mechanisms may be used to couple cover 50 and splice plate 54.

What is claimed is:

1. An assembly for covering a surface of a structure, which structure comprises first and second sides adjoining the surface, comprising:

a. a first cleat adapted to contact the first side and to be secured to at least one of the first side and the surface;

b. a second cleat adapted to contact the second side and to be secured to at least one of the second side and the surface;

c. a first coping section adapted to engage the first cleat; and d. a second coping section adapted to engage the second cleat and having a receptacle, for (1) receiving a portion of the first coping section and (2) accommodating thermal expansion and contraction of the assembly by permitting the received portion of the first coping section to move within the receptacle relative to the second coping section.

2. An assembly according to claim 1 in which the second coping section comprises first, second, and third segments, the first segment adapted to be secured to the surface, the second and third segments defining the receptacle, and the second segment including a plurality of protrusions projecting into the receptacle.

3. An assembly according to claim 1 in which the first coping section comprises a first leg including a plurality of protrusions, at least one of which protrusions is adapted to be received by the receptacle.

4. An assembly according to claim 3 in which the second coping section comprises first, second, and third segments, the first segment adapted to be secured to the surface, the second and third segments defining the receptacle, and the second segment including a plurality of protrusions projecting into the receptacle.

5. An assembly for covering a surface of a structure, which structure comprises first and second sides adjoining the surface, comprising:

a. a first cleat adapted to contact the first side and to be secured to at least one of the first side and the surface;

b. a second cleat adapted to contact the second side and to be secured to at least one of the second side and the surface;

c. a first coping section adapted to engage the first cleat; and d. a second coping section adapted to engage the second cleat and defining a receptacle for receiving a portion of the first coping section, the first coping section comprising a first leg including a plurality of protrusions, at least one of which protrusions is adapted to be received by the receptacle, the second coping section comprising first, second, and third segments, the first segment adapted to be secured to the surface, the second and third segments defining the receptacle, and the second segment including a plurality of protrusions projecting into the receptacle, and in which at least one of the protrusions of the first leg is adapted to engage at least one of the protrusions of the second segment when covering the surface, the assembly defining a gutter bounded at least in part by the second segment.

6. An assembly according to claim 5 in which the first coping section further comprises a second leg including a hooked section adapted to engage the first cleat.

7. An assembly according to claim 6 in which the first and second legs are integrally formed at an angle not greater than 90°.

8. An assembly according to claim 7 in which the first cleat comprises a compressible strip adapted to contact the second leg.

9. An assembly according to claim 8 in which the first and second coping sections are made of plastic.

10. An assembly according to claim 9 further comprising a plate adapted to communicate with the gutter and defining a slot.

11. An assembly according to claim 10 further comprising a cover having a rail adapted to be received by the slot.

12. An adjustable coping assembly comprising:

a. a first coping section;

b. a second coping section defining a receptacle adapted to receive a portion of the first coping section and form a gutter for conveying fluid entering the receptacle;

c. a plate adapted to communicate with the gutter and to be positioned adjacent the first and second coping sections; and d. a cover adapted to attach to the plate and to be positioned adjacent the first and second coping sections opposite the plate.

13. An assembly according to claim 12 in which the first and second coping sections are made of PVC and the receptacle permits relative movement of the first and second coping sections to accommodate thermal expansion and contraction.

14. An assembly according to claim 13 in which the second coping section comprises first, second, and third segments, the first segment adapted to be secured to a surface to be covered, the second and third segments defining the receptacle, and the second segment including a plurality of protrusions projecting into the receptacle.

15. An assembly according to claim 14 in which the first coping section comprises a first leg including a plurality of protrusions, at least one of which protrusions is adapted to be received by the receptacle.

16. An adjustable assembly for covering the top of a parapet having adjoining front and rear sides, comprising:

a. a first cleat adapted to contact the rear side and to be secured to at least one of the rear side and the top of the parapet and comprising a resilient foam strip;

b. a second cleat adapted to contact the front side, to extend above the top of the parapet, and to be secured to at least one of the front side and the top of the parapet;

c. a first coping section adapted to engage the first cleat, to contact the resilient foam strip, and to be positioned above the top of the parapet, comprising:

i. a first leg including a plurality of protrusions projecting from the first leg toward the top and rear side of the parapet; and ii. a second leg integrally formed with the first leg at an angle not greater than 90° and comprising a hooked segment for engaging the rear cleat;

d. a second coping section adapted to engage the second cleat and convey fluid away from the front side, comprising:

i. a first leg comprising a hooked segment for engaging the front cleat; and ii. a second leg integrally formed with the first leg at an angle not greater than 90° and comprising:

A. a first segment secured to the top of the parapet;

B. a second segment integrally formed with the first segment; and

C. a third segment integrally formed with the first and second segments, which second and third segments define a receptacle for receiving at least one of the protrusions of the first leg and conveying fluid and which second segment includes a plurality of protrusions projecting from the second segment away from the top and rear side of the parapet;

e. a plate communicating with the receptacle, defining a slot, positioned between at least a portion of the top of the parapet and the first and second coping sections, and comprising first and second opposed flanged edges; and f. a cover comprising a rail received by the slot and positioned above at least a portion of the first and second coping sections.

17. An assembly according to claim 16 in which the first and second coping sections are made of non-metallic material.

18. A method for covering a surface of a structure, which structure comprises first and second sides adjoining the surface, comprising the steps of:

a. installing a first cleat contacting the first side and secured to at least one of the first side and the surface;

b. installing a second cleat contacting the second side and secured to at least one of the second side and the surface;

c. installing a first coping section engaging the first cleat; and d. installing a second coping section engaging the second cleat and having a receptacle receiving a portion of the first coping section, thereby accommodating thermal expansion and contraction of the assembly by permitting the received portion of the first coping section to move within the receptacle relative to the second coping section.

19. A method according to claim 18 further comprising the step of securing the second coping section to the surface.

20. A method for covering a surface of a structure, which structure comprises first and second sides adjoining the surface, comprising the steps of:

a. installing a first cleat contacting the first side and secured to at least one of the first side and the surface;

b. installing a second cleat contacting the second side and secured to at least one of the second side and the surface;

c. installing a first coping section engaging the first cleat;

d. installing a second coping section engaging the second cleat and defining a receptacle receiving a portion of the first coping section;

e. installing a plate communicating with the receptacle; and f. attaching a cover to the plate.

* * * * *